United States Patent [19]

Polderman et al.

[11] Patent Number: 4,528,257

[45] Date of Patent: Jul. 9, 1985

[54] TONER POWDER AND METHOD OF FORMING FIXED IMAGES

[75] Inventors: Arie Polderman, Velden; Johannes W. H. Handels, Roermond; Johannes H. Kuit, Hengelo, all of Netherlands

[73] Assignee: Océ-Nederland B.V., Venlo, Netherlands

[21] Appl. No.: 502,584

[22] Filed: Jun. 9, 1983

[30] Foreign Application Priority Data

Jun. 17, 1982 [NL] Netherlands ..... 8202452

[51] Int. Cl.[3] ..... G03G 9/08; G03G 9/14

[52] U.S. Cl. ..... 430/109; 524/500; 524/533; 524/568; 524/601; 430/106.6

[58] Field of Search ..... 430/109, 106.6; 524/500, 533, 568, 601

[56] References Cited

U.S. PATENT DOCUMENTS

| | | | |
|---|---|---|---|
| 3,554,836 | 1/1971 | Steindorf | 156/240 |
| 3,853,778 | 12/1974 | Buckley et al. | 252/62.1 |
| 3,893,761 | 7/1975 | Buchan et al. | 355/3 R |
| 3,965,021 | 6/1976 | Clemens et al. | 430/109 |
| 4,385,107 | 5/1983 | Tanaka et al. | 430/109 X |

FOREIGN PATENT DOCUMENTS

| | | | |
|---|---|---|---|
| 57-32447 | 2/1982 | Japan | 430/109 |
| 1245426 | 9/1971 | United Kingdom . | |
| 1414159 | 11/1975 | United Kingdom . | |
| 1478417 | 6/1977 | United Kingdom . | |

OTHER PUBLICATIONS

Patent Abstract of Japan, vol. 6, No. 38 (P-105) [916], Mar. 9, 1982.

*Primary Examiner*—Roland E. Martin
*Attorney, Agent, or Firm*—Albert C. Johnston

[57] ABSTRACT

Toner powder the particles of which are composed of thermoplastic resin, coloring material and possibly other additives such as magnetically attractable material comprises as the principal resin a thermoplastic polymer containing in its molecule one or more each of mutually immiscible crystalline and amorphous polymeric blocks, the crystalline blocks forming the continuous phase in the polymer and having a melting point between 45° and 90° C. and the amorphous blocks having a Tg at least 10° C. above the melting point of the crystalline blocks. The toner powder is especially beneficial for use in a method of transferring and fixing powder images in which an image formed of the powder is softened by heating it on a medium having less surface adhesivity for the softened powder than has the image receiving material and the softened powder on this medium is brought into pressure-contact with substantially unheated image receiving material.

10 Claims, No Drawings

TONER POWDER AND METHOD OF FORMING FIXED IMAGES

This invention relates to a toner powder for developing latent images, and to a method of forming fixed images by transferring and fixing onto receiving material, such as paper, powder images composed of such toner powder.

Copying techniques in which a copy is obtained on a copying material that has not been specially pretreated, e.g. plain paper, have been increasingly prevalent in recent years. In such techniques, a latent image is formed on an image recording material which is to be used repeatedly and the latent image is developed by attraction of a toner powder containing thermoplastic resin, whereupon the powder image is transferred onto a receiving paper and is fixed thereon. The image recording material is, for example, a photoconductive or magnetizable element in the form of a belt or drum.

Methods in which the transfer and fixing of the powder image onto the receiving paper are effected simultaneously are also known. Methods of this kind are described, for example, in UK Pat. No. 1 245 426 and U.S. Pat. Nos. 3,554,836 and 3,893,761.

In such methods, a powder image formed, for example, on a photoconductive element is transferred by pressure onto a medium the surface of which is formed of a material, e.g. silicone rubber, having a lower adhesivity for fused particles of the powder image than has the image receiving paper. The powder image is then transferred to the receiving paper, again by the application of pressure, while being softened by heat before or during its passage through the pressure zone so that it acquires viscous properties causing it, as a result of the pressure exerted on it, to form a cohesive layer that at least partially penetrates into the receiving paper. Upon cooling, the image is permanently bonded to the receiving paper.

The powder of the image in such methods is heated by heating the medium on which the image is situated before transfer to the receiving paper, and possibly by heating the receiving paper. The temperature conditions are so controlled that the powder softens sufficiently to be capable of deforming and being pressed into the receiving paper under a relatively low pressure, but so that the extent of softening does not render the cohesion in the powder so low that powder splitting with some of the powder image remaining on the medium will occur upon separation of the medium and the receiving paper.

The toner powders heretofore proposed for use in the methods according to the above-mentioned patents are made with use of an epoxy resin or a polystyrene resin as the thermoplastic resin. Working systems can be provided with the use of such toner powders, but it has been found that these systems have shortcomings in practice.

In a system in which only the medium is heated to soften the toner powder, a high medium temperature of at least 130° C. is required in order to heat the toner powder in a relatively short time to a temperature within its working range. The working range is the range of temperatures of the toner powder that enable it to be transferred completely from the medium with good adhesion onto the image receiving material. The lower limit of the working range is the temperature at which complete transfer and good adhesion of the powder melt are still just obtained, while the upper limit is the temperature at which splitting of the powder melt still just does not take place.

The high medium temperature required in the system in which the medium only is heated is disadvantageous in that the image recording material (e.g. the photoconductive element) with which the hot medium is repeatedly brought into pressure contact is subjected to a high thermal load, and this has an adverse effect on the service life of the image recording material.

Another disadvantage of that system is that the working range of the toner powder becomes increasingly smaller with extended use of the medium, probably as a result of thermal degradation of the medium, and after some tens of thousands of loadings of the medium a condition is reached in which there no longer is a practical working range.

The medium temperature can be reduced to a range of about 100°–105° C. if the receiving material is heated, for instance, to about 80° C., before being brought into pressure contact with the medium. This system, however, has the disadvantage of requiring a much higher energy consumption, and it restricts the choice of receiving paper. Receiving paper containing a thermoplastic substance, e.g. highly sized paper or paper preprinted with ink containing thermoplastic resin, cannot be used in this system because the resin in the paper is softened and the softened resin is partly transferred via the medium onto the image recording material, thus rendering it unsuitable for further use. In this system too, the working range gradually decreases although the rate at which this takes place is lower than in the system in which only the medium is heated.

The present invention provides a toner powder particularly suitable for use in a method as described above in which only the medium is heated, this toner powder offering the advantage of having a wide working range situated at much lower temperatures than those required for the toner powders conventionally employed in such methods so that the medium can be kept at a much lower temperature during the performance of the method.

The toner powder provided according to the present invention consists of particles composed of thermoplastic resin, coloring material, and possibly additives that are conventional in toner powders, such as e.g. magnetically attractable pigment and/or a charge control agent, and the resin in the particles comprises a thermoplastic polymer containing in its molecule one or more each of mutually immiscible crystalline polymeric blocks and amorphous polymeric blocks, the crystalline blocks forming the continuous phase in the polymer and having a melting point between 45° and 90° C. and the amorphous blocks having a Tg at least 10° C. above the melting point of the crystalline blocks.

The invention also provides a method for transferring and fixing powder images as describe hereinabove, in which an image composed of a toner powder comprising a thermoplastic polymer of the character herein specified is applied to a medium the surface of whch has less adhesivity for the powder than has the image receiving material, the powder of the image is softened by heating it on the medium and the softened powder is brought into contact under pressure with substantially unheated image receiving material which in any case has a temperature below the softening temperature of the powder.

By virtue of this method, the transferring and fixing operations can be performed without heating the image receiving material and with the medium at a temperature considerably less than the temperature heretofore required. This results in a considerably lower energy consumption, and receiving materials can be used which would be unsuitable if heated substantially in order to fix a powder image.

The method according to the invention as employed in an electrophotographic copying process has another advantage in that the thermal load imposed on the photoconductive element is reduced, thus enhancing the serviceable life of that element.

Moreover, the method of the invention provides a wide working range which in most cases extends through 25° to 50° C. or even more, and the lower limit of the working range is at a temperature often only 5° to 10° C. higher than the melting point of the crystalline blocks of the thermoplastic polymer present in the toner powder employed.

The exact temperature level and length of the working range of the toner powder are determined not only by the properties of the toner powder itself but also by the geometry of the apparatus in which the method is performed, the speed of operation of the apparatus, the composition and hardness of the medium from which the powder image is transferred and the pressure with which the softened powder image on the medium is transferred onto the image receiving material. More particularly, the contact time between the image receiving material and the medium supporting the powder image in the copying apparatus is a factor critically relating to the working range.

For a particular apparatus, the working range of the toner powder can be determined fairly readily by measuring the temperature range within which complete transfer and good adhesion of the powder image to the image receiving material are obtained.

Generally speaking, the working range of the toner powder corresponds to the temperature range within which the loss compliance (J″) of the toner powder, measured at a frequency equal to $0.5\times$ the reciprocal of the contact time in the apparatus used for performing the method of the invention, is between $10^{-4}$ and $10^{-6}$ $m^2/N$. A reasonable indication of the position and length of the working range of a particular toner powder of the invention can be obtained by measuring the visco-elastic properties of the toner powder.

The visco-elastic properties of the toner powder are measured in a rheometer, the moduli G′ and G″ being determined as a function of the frequency at a number of different temperatures. The curves found are then reduced to one temperature, the reference temperature.

From this reduced curve the loss compliance (J″) is calculated as a function of the frequency. The displacement factors of the lower and upper limit temperatures ($J''=10^{-6}$ and $10^{-4}$ $m^2/N$ respectively) of the working range can be read off from the loss compliance frequency curve. The lower and upper limit temperatures of the working range can then be calculated by means of the WLF equation prepared from the displacement factors found during the measurements at different temperatures.

The thermoplastic polymers containing crystalline and amorphous blocks as required for the toner powders according to the invention exhibit a reduction of the crystallization temperature on being softened by heat and resolidified by cooling. This possibly is the reason why these toner powders give such good results in the method described hereinabove. Particularly attractive toner powders for use in the method are those showing a crystallization temperature reduction of between 20° and 40° C. These toner powders have a wide working range and yield copies the images of which are no longer tacky practically immediately after being transferred to the copy paper.

The crystallization temperature reduction of the toner powders is measured by means of a DSC-DTA measurement in a Mettler TA 2000B measuring instrument. The measurement is performed as follows:

A sample of about 8 mg of the toner powder is introduced into the measuring instrument and the sample is heated at a linear heating-up rate of 10° C. per minute to a temperature 25° C. above the melting point of the crystalline blocks of the thermoplastic polymer. The sample is held at this temperature for exactly five minutes and then is cooled at a linear cooling rate of 10° C. per minute. During the cooling of the sample, the crystallization temperature is recorded, i.e. the temperature at which the maximum exothermic heat effect is observed. After the sample has cooled, it is again heated at a linear heating-up rate of 10° C. per minute to above the melting temperature of the crystalline blocks in the thermoplastic polymer. During this heating of the sample the melting temperature is recorded, i.e. the temperature at which the maximum endothermic heat effect is observed. The crystallization temperature reduction is the difference between the crystallization temperature and the remelting temperature as so recorded.

Toner powder according to the invention that exhibits a crystallization temperature reduction of more than 40° C. also has a wide working range when used in the method according to the invention, but the copies obtained with such powder may still be tacky for some time so that they may stick to one another if they are stacked directly after leaving the transfer-fixing station. Most of the thermoplastic polymers to be used according to the invention yield toner powders having a crystallization temperature reduction in the preferential 20° to 40° range indicated hereinbefore. Yet the thermoplastic polymers which as such may exhibit a crystallization temperature reduction of more than 40° C. can also yield suitable toner powders, for it has been found that the additives conventionally used in toner powders, e.g. magnetically attractable pigment and carbon black, have a crystallization accelerating effect. Crystallization accelerators known to be such, e.g. hydrophilic silica and sodium benzoate, can also be included in appropriate quantity in the toner powder produced with such thermoplastic polymers in order to bring the crystallization temperature reduction to the required level.

The thermoplastic polymer employed in a toner powder according to the invention contains in its molecule one or more each of mutually immiscible crystalline polymeric blocks and amorphous polymeric blocks, the crystalline blocks forming the continuous phase in the polymer and having a melting point of between 45° and 90° C., and the amorphous blocks having a Tg at least 10° C. above the melting point of the crystalline blocks. The crystalline blocks preferably have a melting point of between 50° and 70° C. and are preferably polar, as polymers having polar crystalline blocks adhere better to the conventional paper supports than do corresponding polymers having apolar crystalline blocks.

Examples of polymeric substances suitable for forming the crystalline blocks of the polymer are: polyamides, such as the polyamide of 6-N-methylamino-hexane carboxylic acid-1 (m.p. 65° C.), poly-decamethylene-3,3'-methylene dibenzamide (m.p. 61° C.); polyesters, such as polycaprolactone (m.p. ±60° C.), polyethylene adipate (m.p. ±60° C.), polyhexamethylene oxalate (m.p. 66° C.), polyhexamethylene sebacate (m.p. 67° C.), polymethylethylene terephthalate (m.p. 70° C.), polydecamethylene azelate (m.p. 69° C.); polyethers, such as polyethylene oxide (m.p. 62° C.), polypropylene oxide (m.p. ±70° C.) and polyhexamethylene oxide (m.p. 58°-62° C.); and polyacrylates, such as poly-N-stearylacrylate (m.p. 68° C.) and polyisobutylacrylate (m.p. 75° C.).

Examples of polymeric substances suitable for forming the amorphous blocks are: polystyrene (Tg±100° C.), polymethylstyrene (Tg 135° C.), polyacrylates and polymethacrylates such as polytertiary butyl acrylate (Tg 73°-108° C.), polymethylmethacrylate (Tg 105° C.), polyisopropyl methacrylate (Tg 80°-85° C.), polyvinyl ethers such as polyisopropenyl methyl ether (Tg 70° C.), polyvinyl chloride (Tg 80° C.). Polystyrene and polymethyl methacrylate are preferred because of their good accessibility.

The crystalline and amorphous blocks can be linked together in the polymer molecule either directly or via an intermediate link. The intermediate link may consist of one single atom or of a relatively low molecular atomic group. The polymer may, for example, be a graft copolymer or a block copolymer. Block copolymers may, for example, belong to the types indicated below, in which A denotes a crystalline block, B an amorphous block and X an intermediate link. (X) denotes that the intermediate link need not be present:

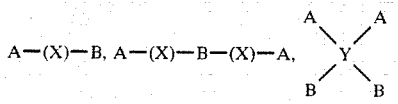

The intermediate link X where present in the polymer may, for example, be —O—, —S—, —CO—, —COO— or —CONH$(CH_2)_n$COO— (n=integer, preferably less than 4). Y is a tetravalent atom such as C or Si.

The composition of the crystalline and amorphous blocks in the thermoplastic polymers used according to the invention is so selected that the blocks are incompatible, i.e. they are insoluble in one another, under the conditions of use of the toner powder. In addition, the Tg of the amorphous block (or blocks) should be at least 10° C. above the melting point of the crystalline block (or blocks). The crystalline block (or blocks) should form the continuous phase in the polymer. The crystalline block content giving this condition depends upon the type of crystalline and amorphous blocks present in the polymer.

Generally speaking, the crystalline block should be present in the polymer in a quantity of at least 65% by weight. The total crystalline block content in the polymer is preferably not more than 95% by weight. The morphology of the polymers can be observed by known techniques, such as electron microscopy, wide-angle X-ray scattering (WAXS), small-angle X-ray scattering (SAXS) and small-angle light-scattering (SALS).

The molecular weight of the thermoplastic polymer and of the blocks present therein should at least be of a magnitude such that phase separation occurs between the crystalline and amorphous blocks of the polymer. Generally this is the case if the amorphous blocks have a number-average molecular weight of at least 8,000. In some cases, e.g. with some block copolymers the amorphous block of which consists of poly-α-methyl styrene, the phase separation occurs already at a lower molecular weight, of e.g. about 5,000. The working range of the toner powder according to the invention also appears to be influenced by the molecular weight of the amorphous blocks in the thermoplastic polymer. The best results are obtained if the amorphous blocks have a number-average molecular weight of at least 10,000, this molecular weight preferably being between 10,000 and 25,000, and more particularly between 10,000 and 15,000.

The amorphous block content of the thermoplastic polymer is preferably 5-30% by weight.

The thermoplastic polymers comprising crystalline and amorphous blocks can be prepared in known manner. Suitable preparation methods are described, inter alia, in:

"Block Copolymers-Overview and Critical Survey", by A. Noskay and J. McGrath, Academic Press, New York (1977);

U.S. Pat. No. 2,975,160;

U.S. Pat. No. 3,050,511;

U.K. Pat. No. 817,693;

Journal of Polymer Science, Vol. 44, page 411 (1960) and Part A., Vol. 2, pp. 417-436 (1964); and Polymer Preprints, Vol. 10, No. 2 pp. 796-819 (September 1969).

Some known methods of preparation are represented in diagrams I to VI of the accompanying Formula sheet.

The toner powder according to the invention may comprise more than one thermoplastic polymer of the type described hereinbefore. In addition to one or more of such thermoplastic polymers it may also comprise amorphous and/or crystalline homopolymer as additive. However, the thermoplastic polymers to be used according to the invention should constitute at least 30%, and preferably at least 50%, by weight of the total quantity of thermoplastic resin present in the toner powder.

When resin mixtures are used, a continuous crystalline phase and a disperse amorphous phase must exist in the mixtures. Good mixing of amorphous homopolymer and thermoplastic polymer can be obtained generally only if the number-average molecular weight of the homopolymer is less than or, at most, equal to the number-average molecular weight of the amorphous block in the thermoplastic polymer.

By mixing the thermoplastic polymer employed according to the invention with another similar polymer or with amorphous and/or crystalline homopolymer, the working range of the toner powder prepared with the mixture can be controlled and adapted to the conditions prevailing in the transfer and fixing apparatus to be used. The following effects result from mixing amorphous and/or crystalline homopolymer with thermoplastic polymer employed according to the invention:

addition of crystalline homopolymer increases the loss compliance (J'');

addition of amorphous homopolymer reduces the loss compliance (J'') somewhat, but the influence generally is small.

The addition of a mixture of amorphous and crystalline homopolymer results in a combination of the above effects. If the thermoplastic polymer to be used according to the invention is mixed with a mixture of an amorphous and a crystalline homopolymer, with the nature and composition of that mixture corresponding or substantially corresponding to the composition of the thermoplastic polymer, then the resulting mixture has a higher loss compliance (J″) than the pure thermoplastic polymer. The fact that the visco-elastic properties of the thermoplastic polymers to be used according to the invention can be influenced by the addition of homopolymer also has the advantage that the syntheses of the polymer containing amorphous and crystalline blocks can be effected less critically, more particularly in respect of the number-average molecular weight of the amorphous blocks. The number-average molecular weight of the amorphous blocks need only have a specific minimum value which, as indicated hereinbefore, is preferably 10,000. If the molecular weight has become too high, a mixture having the required visco-elastic properties can still be obtained by mixing the polymer with the correct quantity of crystalline homopolymer. The use of mixtures may therefore be attractive in terms of the cost of producing the toner powder according to the invention.

In addition to the thermoplastic resin as described hereinbefore, the toner powder according to the invention also comprises coloring material, which may consist of carbon black or of inorganic pigment or dye.

The toner powder may also comprise other additives, the nature of which depends on the purpose for which the toner powder is intended. Thus toner powder for the development of latent magnetic images, or toner powder fed by magnetic conveying means to an electrostatic image to be developed, will also comprise magnetically attractable material, generally in a quantity of between 40 and 70% by weight. Toner powders which are used for the development of electrostatic images may also be made electrically conductive, in manner known per se, by finely dispersing electrically conductive material in the composition of the powder particles in suitable quantities, or depositing the same on the surface of said particles. If the toner powder is to be used in a so-called two-component developer for the development of electrostatic images, the powder particles may also comprise a charge control agent that causes the powder particles, upon tribo-electric charging, to accept a charge of polarity opposite to that of the electrostatic image to be developed. Known materials can be used as the magnetically attractable material, electrically conductive material or charge control media.

The toner powder according to the invention can be prepared in known manner by melting the thermoplastic resin, finely distributing the coloring material, electrically conductive material and crystallization-accelerator substance in the molten resin, cooling the melt to a solid mass and grinding the solid mass into particles of the required particle size, which generally is in the range of 5 to 35 micrometers.

The method of forming fixed images using the toner powder according to the invention, as described hereinbefore, can be performed in apparatus known for this purpose, e.g. as described in U.K. Pat. No. 1,245,426, or U.S. Pat. Nos. 3,554,836, 3,893,761 and 4,068,937. According to the invention, only the medium on which the powder image is carried for transfer to the final receiving material is heated. As already stated, the working range is wide and is at a much lower temperature level than the working range of the known toner powders based on polystyrene or epoxy resins.

The invention will be further understood from the following illustrative examples.

EXAMPLE 1

A block copolymer of polyethylene oxide-polystyrene-polyethylene oxide, in which the polystyrene block had a number-average molecular weight of 13,000 and the polystyrene content amounted to 23% by weight, was prepared by the method represented schematically in diagram I of the Formula sheet.

100 g of this block copolymer were melted and 100 g of magnetically attractable pigment (Bayferrox of Bayer A. G., West Germany) were finely distributed in the melt. The melt was then cooled and the solid mass was ground into particles having sizes of between 10 and 30 micrometers. The toner powder had a crystallization temperature reduction of 27.2° C.

The resulting toner powder was used for the magnetic brush development of electrostatic images formed on a photoconductive element having photosensitive layers of a composition as described in Example 5 of Netherlands patent application No. 7808418, and a plastic support covered with an aluminum layer screened in the manner described in European patent application No. 0 037 193. The electrostatic images were formed on the element by charging the element electrostatically, projecting the image of an original on the photosensitive side of the element, and exposing the element also through the plastic support. The powder images formed on the photoconductive element were transferred onto a silicone rubber coated endless belt medium and from this medium onto unheated plain paper in a transfer and fixing apparatus of an "Océ 1900" copier. The working range was over 40° C. and was at a medium temperature of 70° to 100° C. The medium served satisfactorily for making tens of thousands of copies with use of the toner powder under the stated conditions.

EXAMPLE 2

A toner powder containing the following was prepared in the manner described in Example 1:

30% by weight of the same block copolymer as used in Example 1,

15% by weight of polyethylene oxide having a number-average molecular weight of 20,000, 5% by weight of polystyrene having a number-average molecular weight of 9,000 and 50% by weight of magnetically attractable pigment (Bayferrox of Bayer A. G.).

The working range of this toner powder in the electrophotographic method of Example 1 was at a medium temperature of 75° to 105° C. The toner powder had a crystallization temperature reduction of 21.4° C.

EXAMPLE 3

The electrophotographic method of Example 1 was repeated with use of a toner powder of the following composition:

40% by weight of a block copolymer of polycaprolactone and polystyrene, in which the polystyrene block had a number-average molecular weight of 45,000 and the polystyrene content was 25% by weight, the block copolymer being in accordance with diagram V of the Formula sheet;

10% by weight of polycaprolactone and

50% by weight of magnetically attractable pigment (Bayferrox).

The toner powder had a wide working range which covered a medium temperature of from about 70° to about 105° C. The toner powder had a crystallization temperature reduction of 24° C.

EXAMPLE 4

The electrophotographic method of Example 1 was repeated with the use of toner powders which comprised 50% by weight of magnetically attractable pigment (Bayferrox) and which contained as the thermoplastic resin, respectively:

(a) 50% by weight of a block copolymer of poly-α-methylstyrene and polycaprolactone, in which the poly-α-methylstyrene block had a number-average molecular weight of 15,000 and was present in a quantity of 20% by weight.

(b) 50% by weight of a block copolymer of polystyrene and polypropylene oxide, in which the polystyrene block had a number-average molecular weight of 30,000 and was present in a quantity of 26% by weight.

(c) 50% by weight of a block copolymer of polymethyl methacrylate and polycaprolactone, in which the polymethyl methacrylate block had a number-average molecular weight of 34,000 and was present in a quantity of 23% by weight.

In all cases the results were similar to those of Example 1. The working range was always at a medium temperature of about 70° to about 100° C.

EXAMPLE 5

The electrophotographic method of Example 1 was repeated using toner powers which comprised 50% by weight of magnetically attractable pigment (Bayferrox), and the thermoplastic resin of which consisted of respectively:

(a) a block copolymer of polycaprolactone and polymethyl methacrylate, in which the polymethyl methacrylate block had a number average molecular weight of 6600 and was present in a quantity of 17% by weight. The working range was at a medium temperature of ±80 to ±100° C.

(b) a block copolymer of polycaprolactone and polystyrene, in which the polystyrene block had a number average molecular weight of 7100 and was present in a quantity of 13% by weight. The working range was at a medium temperature of ±75 to ±95° C.

(c) a block copolymer of polystearyl acrylate and polystyrene, in which the polystyrene block had a number average molecular weight of 10500 and was present in a quantity of 20% by weight. The working range was at a medium temperature of ±75 to ±105° C.

(d) a block copolymer of polyhexamethylene sebacate and polystyrene, in which the polystyrene block had a number average molecular weight of 15000 and was present in a quantity of 16% by weight. The working range was at a medium temperature of ±70 to ±100° C.

(e) a block copolymer of polycaprolactone-polystyrene-polycaprolactone, in which the polystyrene block had a number average molecular weight of 12000 and was present in a quantity of 24% by weight. The working range was at a medium temperature of ±75 to ±100° C.

All toner powders described in the Examples had a crystallization temperature reduction of between 20° and 40° C.

Formula sheet

I.

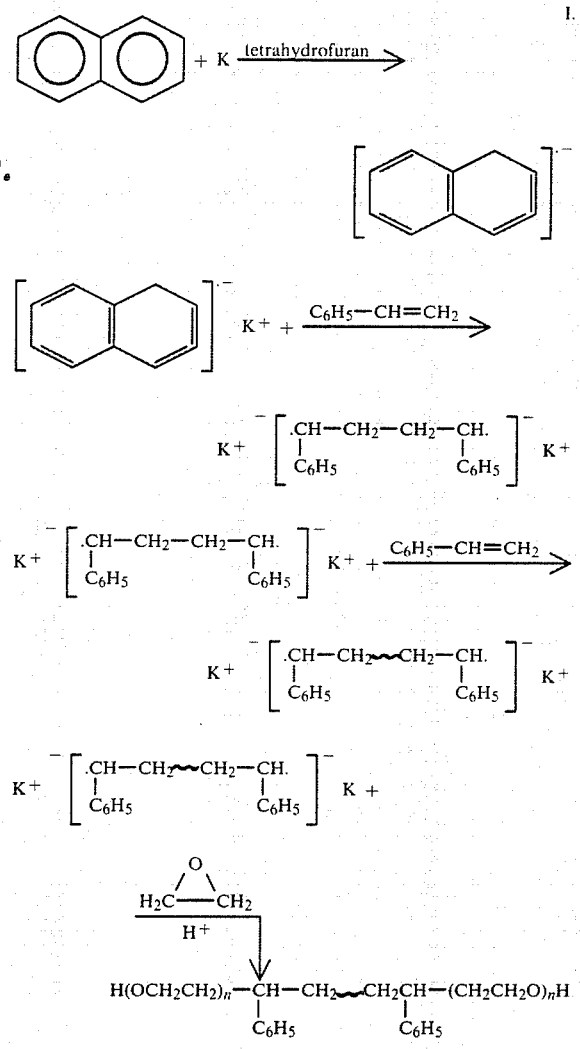

II.

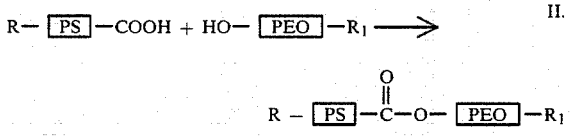

PS = polystyrene PEO = polyethylene oxide

III.

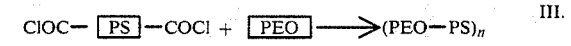

IV.

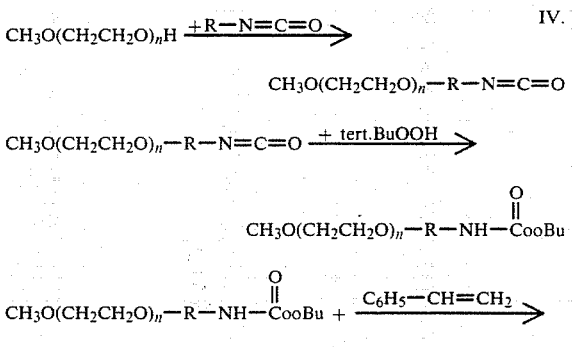

-continued

Formula sheet

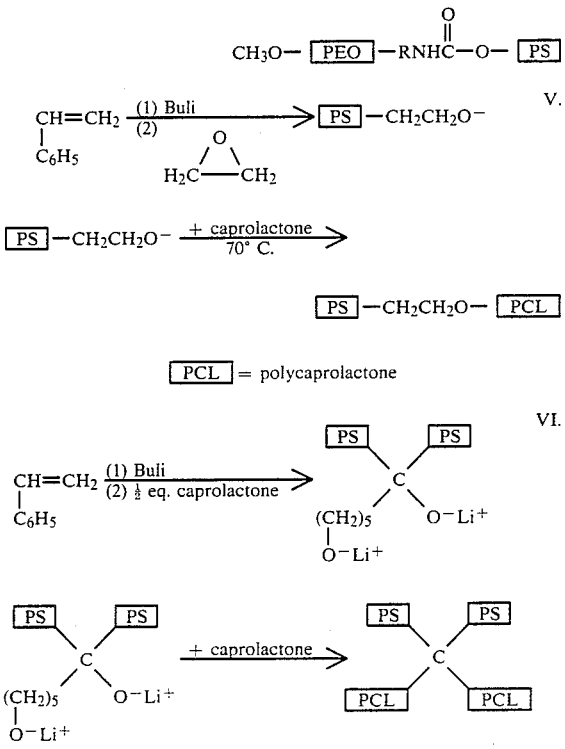

We claim:

1. A toner powder consisting of heat-fusible particles composed of thermoplastic resin and coloring material with or without other additives, said resin comprising predominantly a thermoplastic block copolymer containing in its molecule at least 65% by weight of crystalline polymeric blocks and at least 5% by weight of amorphous polymeric blocks, said crystalline blocks and said amorphous blocks mutually being immiscible with one another and respectively forming in said block copolymer a continuous crystalline polymeric phase and a disperse amorphous polymeric phase, said crystalline blocks having a melting point between 45° and 90° C. and said amorphous blocks having a Tg at least 10° C. above the melting point of the crystalline blocks, said particles exhibiting a crystallization temperature reduction of between 20° and 40° C.

2. A toner powder according to claim 1, said crystalline blocks being polar and having a melting point of between 50° and 70° C.

3. A toner powder according to claim 1, said block copolymer containing 70 to 95% by weight of said crystalline blocks.

4. A toner powder according to claim 1, said amorphous blocks having a number-average molecular weight of between 10,000 and 25,000.

5. A toner powder according to claim 1, said block copolymer constituting at least 50% by weight of the total quantity of thermoplastic resin in said particles.

6. A toner powder according to claim 5, said thermoplastic resin consisting essentially of a mixture of said thermoplastic block copolymer and amorphous and/or crystalline homopolymer.

7. A toner powder consisting of heat-fusible particles composed of thermoplastic resin and coloring material with or without other additives, said resin consisting predominantly of a thermoplastic block copolymer containing 70 to 95% by weight of crystalline polymeric blocks of polyethylene oxide, polycaprolactone, or polypropylene oxide, having a melting point between about 50° and about 70° C. and 5 to 30% by weight of amorphous blocks of polystyrene, poly-α-methylstyrene, or polymethyl methacrylate, having a Tg at least 10° C. above the melting point of said crystalline blocks, said crystalline blocks and said amorphous blocks mutually being immiscible with one another and respectively forming in said block copolymer a continuous crystalline polymeric phase and a disperse amorphous polymeric phase, said powder particles exhibiting a crystallization temperature reduction of between 20° and 40° C.

8. A toner powder according to claim 7, said block copolymer consisting essentially of about 70 to 80% by weight of crystalline blocks of polyethylene oxide and about 20 to 30% by weight of amorphous blocks of polystyrene.

9. A toner powder according to claim 8, said resin consisting essentially of a mixture of at least 70% by weight of said block copolymer and minor proportions of polyethylene oxide homopolymer and polystyrene homopolymer.

10. A toner powder according to claim 7, said block copolymer consisting essentially of about 70 to 80% by weight of crystalline blocks of polycaprolactone and about 20 to 30% by weight of amorphous blocks of polystyrene, poly-α-methylstyrene, or polymethyl methacrylate.

* * * * *